US008746956B2

(12) United States Patent
Degen et al.

(10) Patent No.: US 8,746,956 B2
(45) Date of Patent: Jun. 10, 2014

(54) VIBRATOR ARRANGEMENT AND METHOD OF PRODUCING MATERIAL COLUMNS IN THE GROUND

(75) Inventors: Wilhelm Degen, Irvine, CA (US); Alexander Degen, Dubai (AE)

(73) Assignees: Wilhelm Degen, Irvine, CA (US); Alexander Degen, Dubai (AE)

( * ) Notice: Subject to any disclaimer, the term of this patent is extended or adjusted under 35 U.S.C. 154(b) by 1298 days.

(21) Appl. No.: 12/223,407

(22) PCT Filed: Feb. 1, 2007

(86) PCT No.: PCT/EP2007/000883

§ 371 (c)(1), (2), (4) Date: Jun. 15, 2009

(87) PCT Pub. No.: WO2007/090566

PCT Pub. Date: Aug. 16, 2007

(65) Prior Publication Data

US 2009/0317188 A1 Dec. 24, 2009

(30) Foreign Application Priority Data

Feb. 3, 2006 (DE) ..... 10 2006 005 242

(51) Int. Cl.

| | |
|---|---|
| ***B01F 11/00*** | (2006.01) |
| ***E02D 3/054*** | (2006.01) |
| ***E02D 27/26*** | (2006.01) |

(52) U.S. Cl.

CPC ..... *E02D 3/054* (2013.01); *E02D 27/26* (2013.01)

USPC ..... 366/120; 175/19; 172/40

(58) Field of Classification Search

CPC ..... E02D 27/26; E02D 27/28; E02D 3/046; E02D 3/054; A01B 13/08; E21B 7/26

USPC ..... 366/120–123, 125; 405/233, 240; 172/40; 175/19, 21, 56

See application file for complete search history.

(56) References Cited

U.S. PATENT DOCUMENTS

| | | | | |
|---|---|---|---|---|
| 2,070,956 | A * | 2/1937 | Pelton | 366/120 |
| 5,406,294 | A * | 4/1995 | Silvey et al. | 343/709 |
| 5,449,493 | A * | 9/1995 | Rokugawa et al. | 366/120 |

FOREIGN PATENT DOCUMENTS

| | | | |
|---|---|---|---|
| DE | 29 49 938 | | 6/1981 |
| DE | 2943938 | | 6/1981 |
| DE | 296 11 427 | U1 | 10/1996 |
| DE | 196 28 769 | A1 | 12/1996 |
| DE | 101 49 878 | A1 | 4/2003 |
| DE | 10314368 | A1 | 3/2005 |
| FR | 841 545 | | 5/1939 |
| FR | 1277369 | | 12/1961 |
| GB | 650083 | | 2/1951 |
| GB | 2286613 | A1 | 8/1995 |
| GB | 2 311 083 | | 9/1997 |
| RU | 2049855 | C1 | 12/1995 |
| SU | 365450 | A1 | 1/1973 |
| SU | 1222793 | A1 | 4/1986 |
| SU | 1758164 | A1 | 8/1992 |

* cited by examiner

*Primary Examiner* — Timothy Cleveland

(74) *Attorney, Agent, or Firm* — Muirhead and Saturnelli, LLC

(57) ABSTRACT

A vibrator arrangement for producing material columns in the ground comprises an elongate vibrating body with an outer surface having a girth and at least one projection extending at least partially around the girth of the vibrating body. A method of producing a material column in the ground may use such a vibrator arrangement.

15 Claims, 3 Drawing Sheets

VIBRATOR ARRANGEMENT AND METHOD OF PRODUCING MATERIAL COLUMNS IN THE GROUND

TECHNICAL FIELD

This application relates to a vibrator arrangement and to a method of producing material columns which are incorporated into the ground in order to improve the soil properties of ground intended to support buildings.

BACKGROUND OF THE INVENTION

Two basic methods of producing material columns in the ground have been known for a long time. In the "wet tamping compaction" method, a column-like hole is produced and then flushing water is charged into the hole. Rapidly moving a vibrator up and down, in combination with the water flushing results in a flow which erodes the soil material in such a way that an annular space is created between the depth vibrator and the adjoining soil region, thereby making it possible to transport gravel, recycled concrete, sand or similar granular bulk material along the depth vibrator and into the hole. Apart from the eroding action, the water performs further important functions as well, namely that of stabilizing the hole wall against any collapse of the wall caused by the pressure of the groundwater and that of preventing gravel from jamming between the hole wall and the depth vibrator. The upwardly flowing water eliminates these "bridges" formed by jamming and thus ensures that the gravel is transported depthwise down to the lower end of the vibrator, where it is tamped to form a so-called "tamped column". A particular problem associated with this method is that of disposing of the extremely sludgy flushing water, something which entails high costs inter alia, and another problem is that contamination which may be present in the soil is washed out of the soil to the surface.

In a second method, the "dry tamping compaction" method, a material-conveying pipe is fastened laterally alongside a vibrator and is used to transport material to the lower end of the depth vibrator. Disadvantages in relation to the wet tamping compaction technique are the lower gravel-conveying capacity (volume per time) and the higher costs for the more elaborate equipment.

In both methods, the material is transported to the lower end of the vibrator solely under the force of gravity acting on the material. Without flushing water or without a conveying pipe it is not possible for the gravel to be conveyed into soil layers underneath the ground water level. To accelerate transportation, or if the transportation of material has come to a standstill, the only remaining option is to enlarge the annular space, although this is in most cases undesirable since it results in soil being unnecessarily washed out and in an increased requirement for flushing water.

Accordingly, it would be desirable to provide a device for and a method of producing tamped columns in which, by contrast with the prior art, there is no requirement, or only a relatively low requirement, for flushing water and no conveying pipe is necessary either.

SUMMARY OF THE INVENTION

A vibrator arrangement according to one exemplary embodiment of the system described herein comprises an elongate vibrating body with an outer surface having a periphery. On this periphery is arranged a projection which extends away from the vibrating body in a lateral direction and which extends at least in sections around the periphery.

When using such a vibrator arrangement to produce material columns in the ground, after producing a hole, after sinking the vibrator arrangement into the hole and after introducing material, the transportation of the material to a lower end of the vibrating body is not effected under the force of gravity alone. During an up and down movement of the vibrator arrangement, this transportation of material is additionally assisted by the projection which acts as a mechanical transporting device, similarly to a shovel. During a downward movement of the vibrating body, this projection which extends at least in sections around the periphery and protrudes in a lateral direction presses a material situated in an annular space underneath the projection further depthwise in the direction of the lower end of the vibrating body, where it is compacted to form a tamped column.

During a subsequent upward movement, owing to the conical form of the projection the material is, however, not conveyed upward again but displaced laterally into the soil in order, during a further downward movement, to be captured by the projection and transported into the depth of the column formation.

The projection is preferably designed in such a way that it becomes broader at an acute angle in the direction toward a lower end of the vibrating body. The geometry of this projection can in this case correspond to the geometry of a truncated cone or of a truncated pyramid. Furthermore, the projection may comprise a plurality of segments arranged in the peripheral direction.

In another embodiment of the system described herein, it is also possible for a plurality of projections to be arranged along the longitudinal direction of the vibrating body.

In a further embodiment, the projections are movable along the longitudinal direction of the vibrating body.

In addition, the projection or individual segments of the projection may be designed such that they can be folded in the direction of the outer surface of the vibrating body or such that they can be retracted into the vibrating body.

The vibrator arrangement may be designed, in particular, as a depth vibrator having an eccentric arranged in the vibrating body or else as a top vibrator having an eccentric arranged on an upper end of the vibrating body.

The mechanical assistance provided by the projection to transport the material makes it possible to increase the material flow per unit time by more than 50 percent and to at least halve the flushing water required. Instead of water, air or another gas blown into the annular space can also be used here for "flushing". The water or gaseous flushing medium can even be dispensed with completely in some soils.

BRIEF DESCRIPTION OF THE DRAWINGS

The system described herein will be explained in more detail below with reference to exemplary embodiments represented in the figures.

DETAILED DESCRIPTION OF VARIOUS EMBODIMENTS

Unless otherwise stated, reference numbers repeated in the figures designate similar parts with similar meanings.

Figure 1:
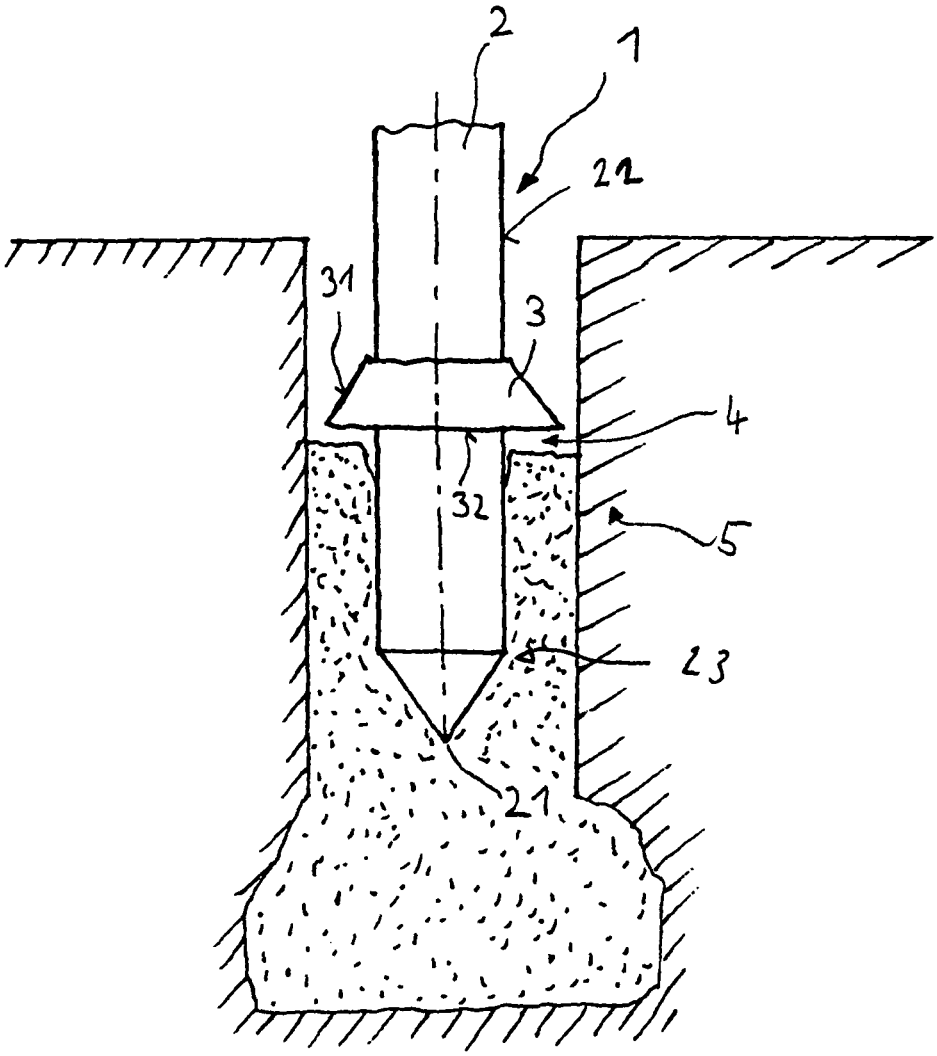
FIG. 1 shows an example of a vibrator arrangement according to the system described herein with a vibrating body and a projection.

FIG. 1 is a side view showing an embodiment of the vibrator arrangement 1 according to the system described herein. This arrangement comprises an elongate vibrating body 2 which has an outer surface 22 with a periphery and which also has a lower end 21 and an upper end (not shown). Arranged along the periphery of the outer surface 22 is a projection 3 which protrudes in a lateral or radial direction from the vibrating body 2. This projection 3 broadens out in the direction of the lower end 21, i.e. the projection protrudes increasingly from the outer surface 22 of the vibrating body 2 in the direction of the lower end 21.

With reference to FIG. 1, the projection can extend annularly around the periphery of the vibrating body 2.

The vibrating body 2 can, in particular, be of cylindrical design and thus have a circular cross section. However, the vibrating body can also have any other cross section, in particular a rectangular cross section.

The projection 3 has, for example, the geometry of a truncated cone or truncated pyramid traversed by the vibrating body.

In the example represented, a lower side 32 of the projection facing in the direction of the lower end of the vibrating body protrudes approximately at a right angle from the vibrating body 2, whereas an upper side 31 of the projection tapers with increasing distance from the lower end 21 of the vibrating body, with the result that the projection 3 in the example has the form of a truncated cone traversed by the vibrating body.

The projection 3 can be arranged at any longitudinal position of the vibrating body 2. In the example shown in FIG. 1, this projection is arranged at a distance from the lower end 21 of the vibrating body 2.

Figure 2:
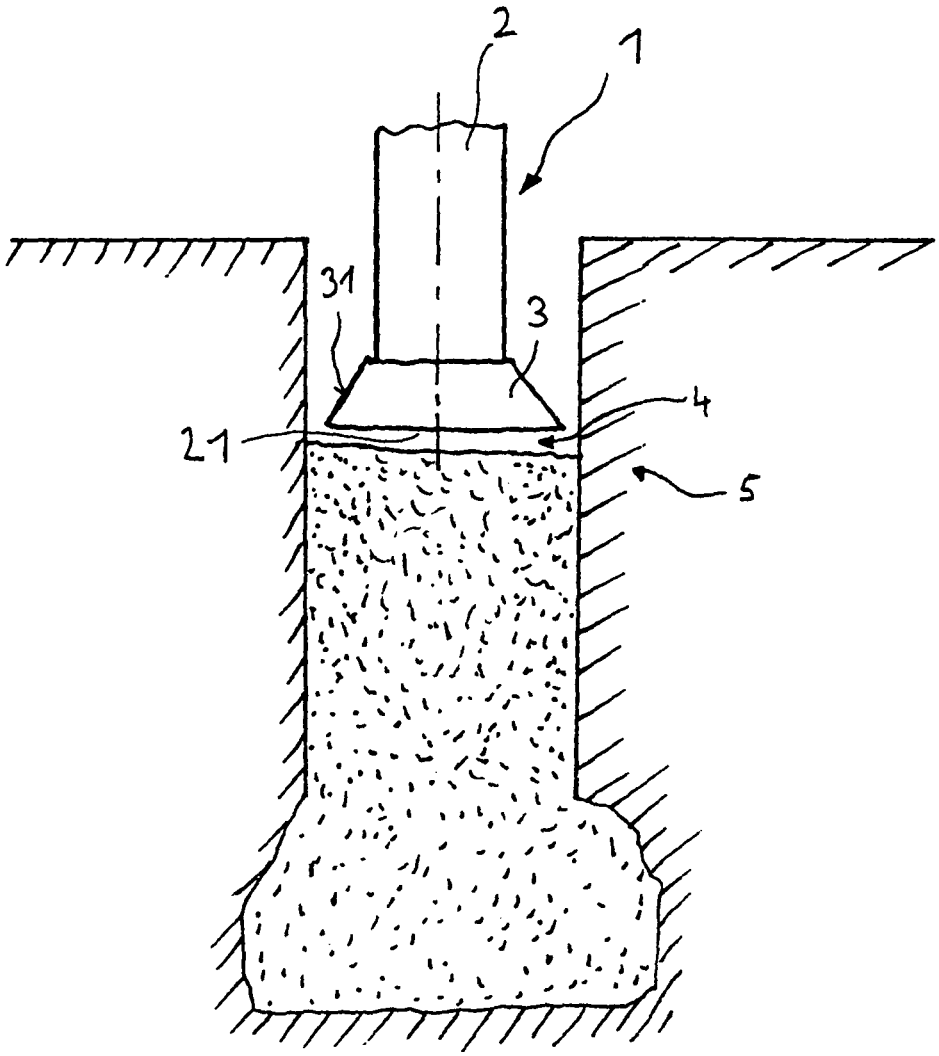
FIG. 2 shows a further example of a vibrator arrangement according to the system described herein with a vibrating body, in which the projection is arranged on the lower end of the vibrating body.

The exemplary embodiment according to FIG. 2 differs from that shown in FIG. 1 in that the projection 3 is arranged on the lower end 21 of the vibrating body.

The vibrator arrangement can be embodied, for example, as a depth vibrator or as a top vibrator. In the case of a depth vibrator, an eccentric (not shown) which generates vibrating motions is arranged in the vibrating body 2. In the case of a top vibrator, the eccentric (not shown) is arranged above the upper end of the vibrating body 2.

Exemplary embodiments of the projection 3 are explained below with reference to FIG. 3.

Figure 3C:
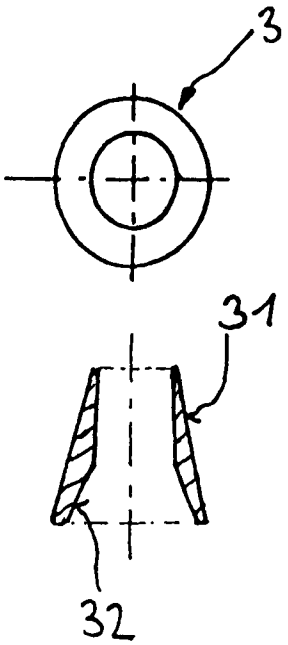
FIGS. 3A-C show different forms of the projections according to various embodiments of the system described herein.
Figure 3B:
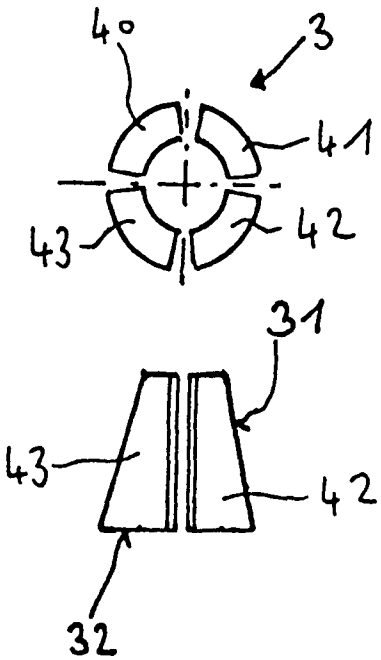
Figure 3A:
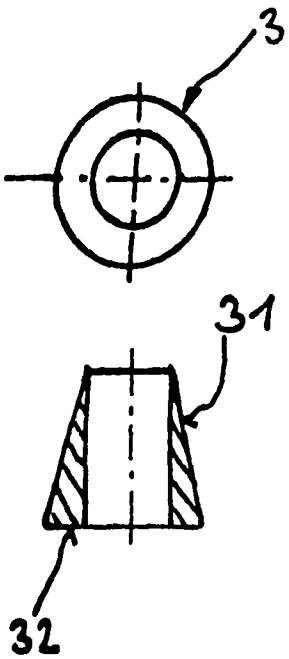

In the example represented in FIG. 3A, the upper side 31 of the projection 3 extends conically at an acute angle to the longitudinal direction of the elongate vibrating body 2, whereas the lower side 32 extends at an approximately right angle with respect to the longitudinal direction. The projection 3 here is formed as a solid body.

FIG. 3B shows an embodiment of a segmented projection 3 having a plurality of segments 40, 41, 42, 43 arranged adjacent to one another in the peripheral direction. This embodiment makes it possible to fold in the projection 3 relative to the vibrating body 2 or to retract the projection 3 into the vibrating body 2.

The embodiment of the projection 3 shown in FIG. 3C differs from the embodiment in FIG. 3A in that the lower side 32 of the projection likewise has a conical, tapering profile, which means that the aforementioned shovel action of the projection 3 can be improved.

In a method according to according to an embodiment of the system described herein for producing a material column in the ground 5, first of all a column-like hole is produced. Such a hole typically has a diameter from about 50 cm to about 100 cm. The vibrating body 2 according to the an embodiment of the system described herein that is used typically has external dimensions from about 30 cm to 50 cm.

After sinking the vibrator 1 to a desired depth, gravel, recycled concrete, sand or similar granular material is introduced into an annular space 4 between the outer surface 22 of the vibrating body 2 and the surrounding soil, and flushing water or another gaseous "flushing medium", in particular air, is optionally fed in as well. The depth vibrator 1 is then regularly moved up and down in such a way that the material situated below the vibrating body 2 is compressed to form a tamped column.

In this arrangement, the material situated in the annular space 4 is captured by the projection 3 during a downward movement of the vibrating body and transported in the direction of the lower end of the vibrating body 2. At the same time, any jamming of material which may have occurred in the annular space 4 between the vibrating body 2 and ground 5 is eliminated. During the upward movement, the oblique profile of the upper side 31 of the projection ensures that the material is displaced laterally and not transported upward again. In the case of a projection which can be folded in or retracted, said projection can be folded in/retracted during the upward movement.

In addition, there is also the possibility of arranging the projection on the vibrating body so as to be movable in the longitudinal direction, thereby making it possible to transport material or to compact material merely through an up and down movement of the projection 3.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

The invention claimed is:

1. A vibrator arrangement for producing material columns in the ground, comprising:

a depth vibrator having an elongate vibrating body with an outer surface haying a periphery; and at least one projection extending at least partially around the periphery of the vibrating body, wherein the at least one projection enables a shovel action and is configured to press a material situated in an annular space underneath the projection deeper in the direction of the lower end of the vibrating body when the vibrating body is moved downwards, wherein the at least one projection broadens out in the direction of the lower end of the vibrating body.

2. The vibrator arrangement as claimed in claim 1, wherein the vibrating body has a lower end and in which a periphery of the projection increases in the direction of the lower end of the vibrating body.

3. The vibrator arrangement as claimed in claim 2, wherein the projection has the form of at least one of: a truncated cone and a truncated pyramid.

4. The vibrator arrangement as claimed in claim 1, further comprising:

a plurality of projections arranged along a longitudinal direction of the vibrating body.

5. The vibrator arrangement as claimed in claim 1, wherein the projection is arranged on a lower end of the vibrating body.

6. The vibrator arrangement as claimed in claim 1, wherein the projection is movable along a longitudinal direction of the vibrating body.

7. The vibrator arrangement as claimed in claim 1, wherein the at least one projection is at least partially foldable or retractable towards the vibrating body.

8. The vibrator arrangement as claimed in claim 1, wherein the projection is composed of a plurality of segments in the peripheral direction.

9. A vibrator device, comprising:

a depth vibrator having a vibrating body including a lower end and an outer surface having a periphery; and at least one projection extending at least partially around the periphery of the vibrating body, wherein the at least one projection has a tapering profile that radially broadens in a longitudinal direction towards the lower end of the vibrating body, wherein the at least one projection enables a shovel action and is configured to press a material situated in an annular space underneath the projection deeper in the direction of the lower end of the vibrating body when the vibrating body is moved downwards, wherein the at least one projection broadens out in the direction of the lower end of the vibrating body.

10. The vibrator device as claimed in claim 9, wherein the tapering profile is at least one of: a truncated cone and a truncated pyramid.

11. The vibrator device as claimed in claim 9, further comprising: a plurality of projections disposed along the longitudinal direction of the vibrating body.

12. The vibrator device as claimed claim 9, wherein the at least one projection is movable along the longitudinal direction of the vibrating body.

13. The vibrator device as claimed in claim 9, wherein the at least one projection is at least partially foldable in the longitudinal direction.

14. The vibrator device as claimed in claim 9, wherein the at least one projection is retractable towards the vibrating body.

15. The vibrator device as claimed in claim 9, wherein the at least one projection includes a plurality of segments in the peripheral direction.

* * * * *